US007174820B2

(12) United States Patent
Huang

(10) Patent No.: US 7,174,820 B2
(45) Date of Patent: Feb. 13, 2007

(54) RIP FENCE FOR CUTTING MACHINE

(75) Inventor: Peter Huang, Taichung (TW)

(73) Assignee: Durq Machinery Corp., Taichung (TW)

( * ) Notice: Subject to any disclaimer, the term of this patent is extended or adjusted under 35 U.S.C. 154(b) by 308 days.

(21) Appl. No.: 10/974,767

(22) Filed: Oct. 28, 2004

(65) Prior Publication Data

US 2006/0090619 A1 May 4, 2006

(51) Int. Cl.
*B26D 7/02* (2006.01)
*B26D 7/01* (2006.01)

(52) U.S. Cl. ..... 83/446; 83/438; 83/468.7; 83/477.2; 144/287; 269/318

(58) Field of Classification Search ..... 83/438, 83/441, 446, 471.3, 472, 473, 477, 477.1, 83/477.2, 478, 486, 486.1, 487, 488, 489, 83/490, 581; 144/253.1, 286.1, 287, 307; 269/74, 81, 318
See application file for complete search history.

(56) References Cited

U.S. PATENT DOCUMENTS

| | | | | | |
|---|---|---|---|---|---|
| 2,771,103 | A * | 11/1956 | Odlum et al. | ..... | 83/438 |
| 2,806,493 | A * | 9/1957 | Gaskell | ..... | 83/438 |
| 4,011,782 | A * | 3/1977 | Clark et al. | ..... | 83/471.3 |
| 4,658,687 | A * | 4/1987 | Haas et al. | ..... | 83/438 |
| 5,181,446 | A * | 1/1993 | Theising | ..... | 83/438 |
| 5,249,496 | A * | 10/1993 | Hirsch et al. | ..... | 83/471.3 |
| 5,347,902 | A * | 9/1994 | Brickner et al. | ..... | 83/468.3 |
| 6,016,732 | A * | 1/2000 | Brault et al. | ..... | 83/471.3 |
| 7,013,780 | B2 * | 3/2006 | Brunson | ..... | 83/471.3 |
| 7,114,425 | B2 * | 10/2006 | Romo et al. | ..... | 83/471.3 |

* cited by examiner

*Primary Examiner*—Boyer D. Ashley
*Assistant Examiner*—Edward Landrum
(74) *Attorney, Agent, or Firm*—Bacon & Thomas, PLLC

(57) ABSTRACT

A rip fence for movable and positionable use on a worktable of a cutting machine includes an adjusting handle for control locking of the fence to the worktable, and a trigger, which keeps the fence locked to the worktable when it is not pressed and, which enables the user to unlock the fence from the worktable by operating the adjusting handle when it is pressed.

5 Claims, 6 Drawing Sheets

RIP FENCE FOR CUTTING MACHINE

BACKGROUND OF THE INVENTION

1. Field of the Invention

The present invention relates generally to a rip fence used with a worktable of a cutting machine, such as table saw.

2. Description of the Related Art

FIG. 1 shows a conventional rip fence 2 installed on the worktable 1*a* of a table saw 1. The rip fence 2 can be moved on the top surface of the worktable 1*a* to the desired position and then locked. The rip fence 2 comprises a fence body 2*a* approximately equal to the width of the worktable 1*a*, a fence adjusting handle 2*b* pivoted to one end of the fence body 2*a*, a front clamp 2*c* pivoted to the front end of the fence body 2*a* corresponding to the front side of the worktable 1*a*, a rear clamp 2*d* pivoted to the rear end of the fence body 2*a* corresponding to the rear side of the worktable 1*a*, and a linking mechanism (not shown) connecting the front clamp 2*c* and the rear clamp 2*d* to the fence adjusting handle 2*b*. The fence adjusting handle 2*b* is turnable relative to the fence body 2*a* between the pressed position as shown in FIG. 1 where the front clamp 2*c* and the rear clamp 2*d* are respectively clamped on the front and rear sides of the worktable 1*a* to lock the fence body 2*a* to the worktable 1*a*, and the lifted position as shown in FIG. 2, where the front clamp 2*c* and the rear clamp 2*d* are respectively disengaged from the worktable 1*a* for enabling the user to move the fence body 2*a* on the top surface of the worktable 1*a* to the desired position. This structure of rip fence 2 is functional, however it is not safe in use. During cutting operation, the fence adjusting handle 2*b* may be lifted accidentally to unlock the fence body 2*a*. If the user keeps operating the sawing machine at this time, an accident may occur.

SUMMARY OF THE INVENTION

The present invention has been accomplished under the circumstances in view. It is the primary objective of the present invention to provide a rip fence, which is easy to adjust and safe in use.

To achieve this objective of the present invention, the rip fence, which is movable on and lockable to a worktable of a machine, comprises a main body having a front end and a rear end, an adjusting handle pivoted to the front end of the main body, a trigger pivoted to the adjusting handle and turnable between a first position and a second position, a clamp provided at the rear end of the main body and having a stop portion stoppable at a rear end of the worktable, and a link coupled between the adjusting handle and the clamp. The trigger has a stop portion, which is stoppable against a front end of the worktable when the trigger is moved to the first position and is away from the front end of the worktable when the trigger is moved to the second position, and a pressable portion which can be pressed by a user to move the trigger from the first position to the second position. When the trigger is positioned at the second position and the adjusting handle is lifted relative to the main body, the link will be forced to move the clamp away from the worktable, for enabling the rip fence to be moved on the worktable to a desired position.

DETAILED DESCRIPTION OF THE INVENTION

Figure 1:
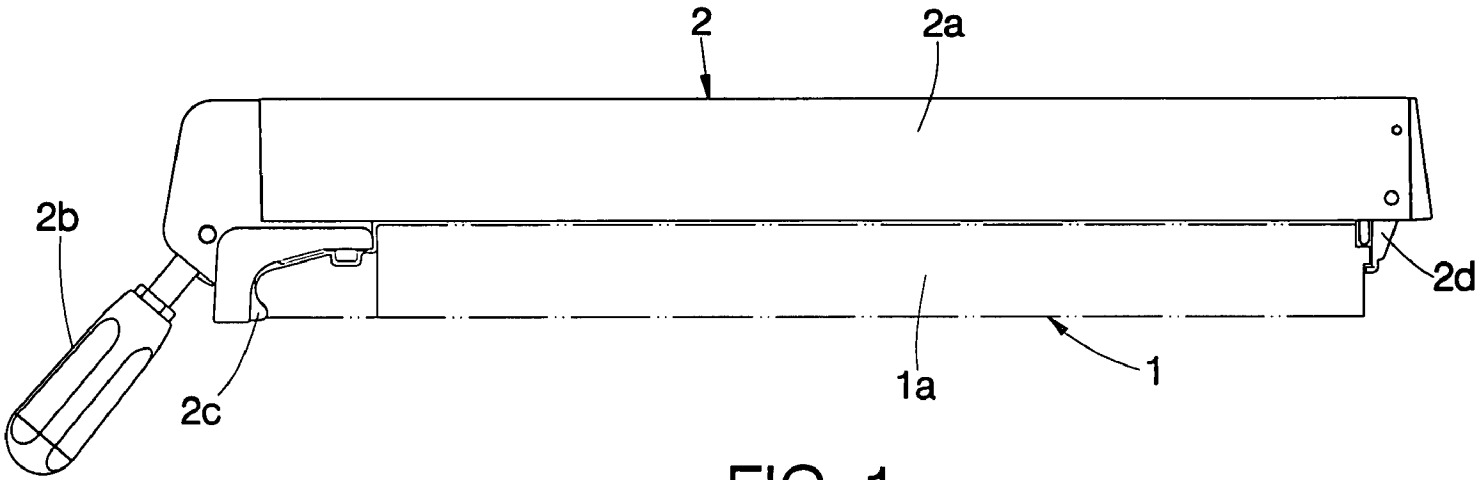
FIG. 1 PRIOR ART
FIG. 1 is a schematic drawing showing a rip fence locked to the worktable of a sawing machine according to the prior art.
Figure 2:
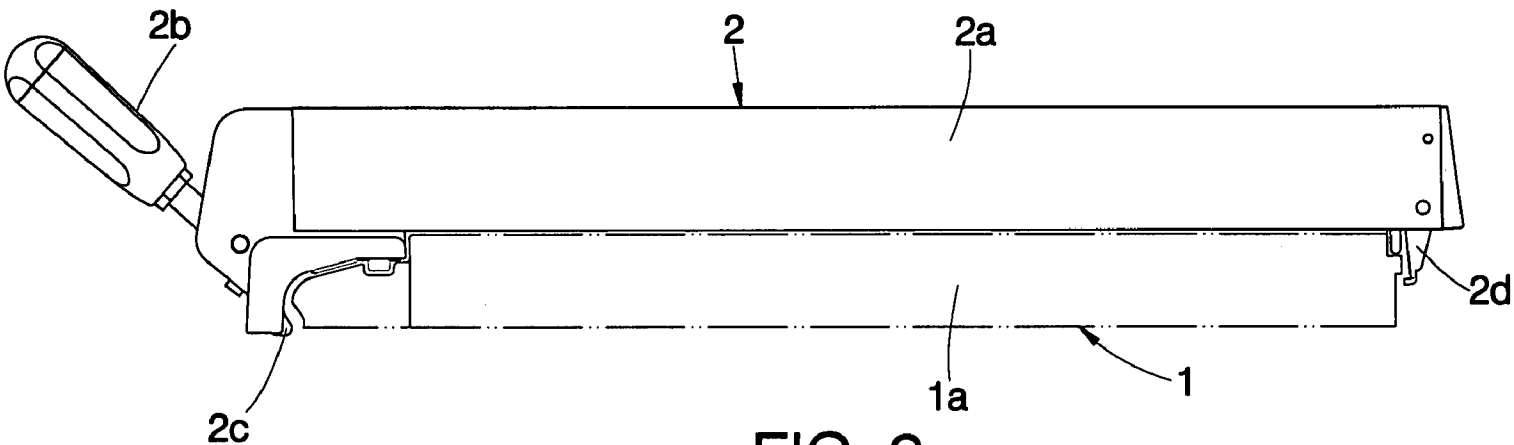
FIG. 2 PRIOR ART
FIG. 2 is similar to FIG. 2 but showing the unlocked status of the rip fence.
Figure 3:
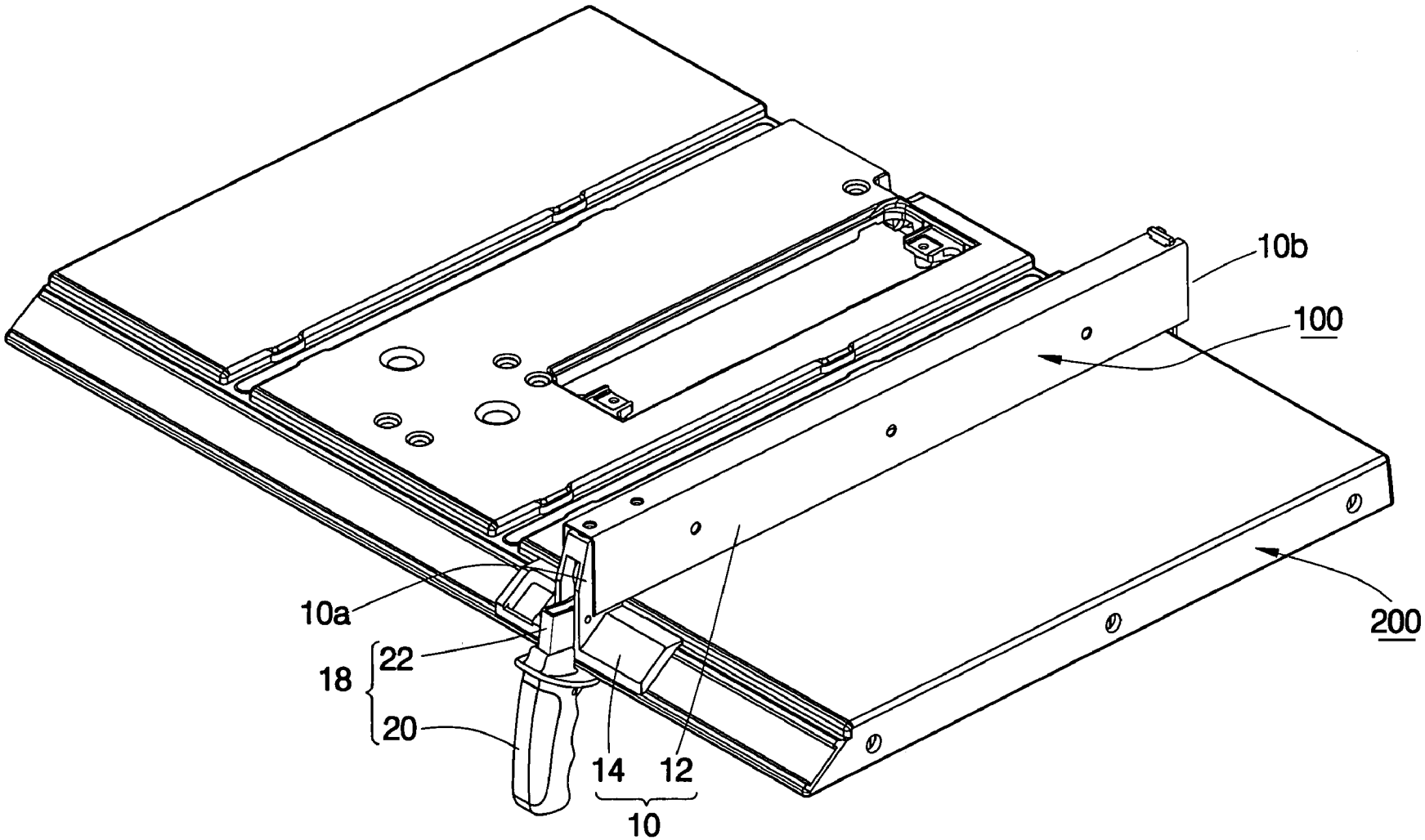
FIG. 3 is a schematic drawing showing a rip fence installed on the worktable of a sawing machine according to the present invention.
Figure 4:
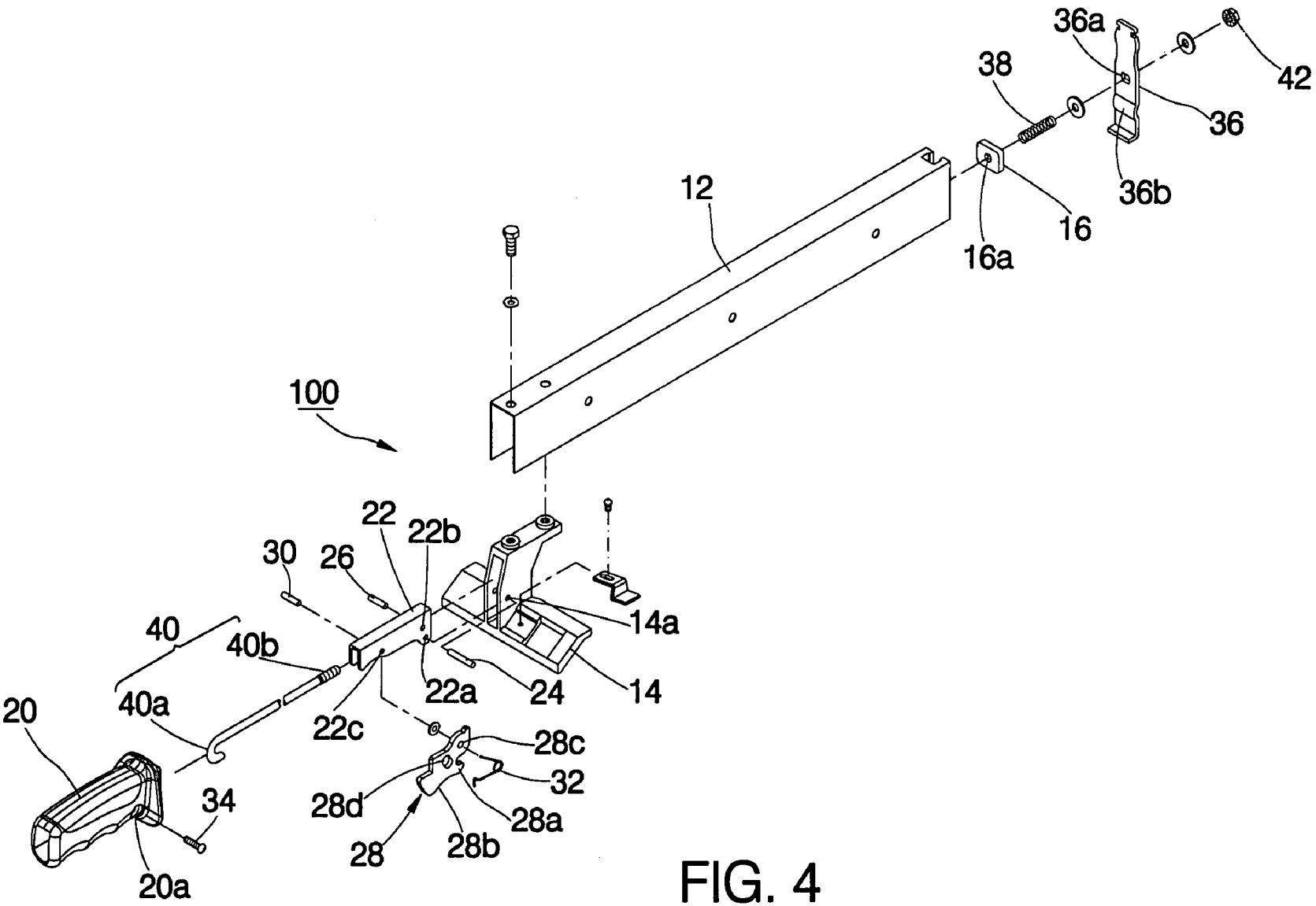
FIG. 4 is an exploded view of the rip fence according to the present invention.
Figure 5:
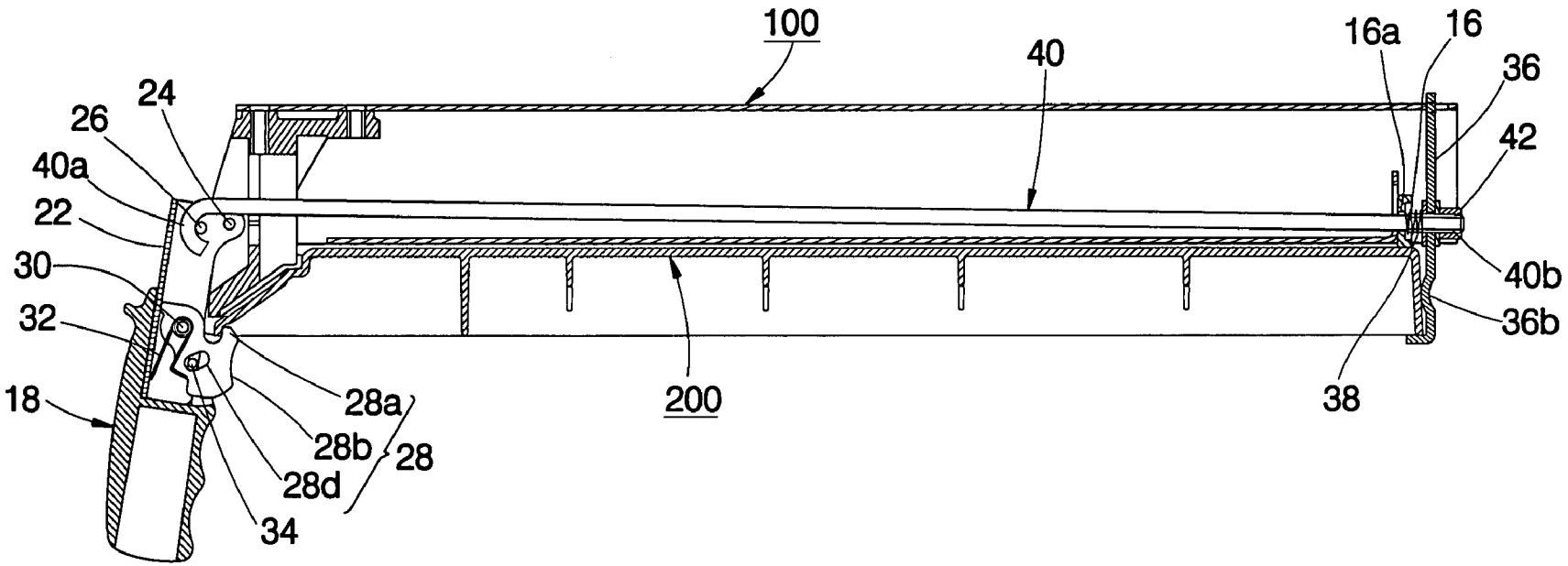
FIG. 5 is a sectional view showing the rip fence locked to the worktable according to the present invention.

As shown in FIGS. 3–5, a rip fence 100 is slidably mounted on the top of the worktable 200 of a cutting machine (for example, a table saw). The rip fence 100 comprises a main body 10, an adjusting handle 18, a trigger 28, a spring member 32, a clamp 36, and a link 40.

The main body 10 has a front end 10*a* and a rear end 10*b*, and is comprised of a channel bar 12, a guiding seat 14 and a stop plate 16. The guiding seat 14 is provided at one end of the channel bar 12. The stop plate 16 is set near the rear end 10*b* of the main body 10, having a through hole 16*a*. The guiding seat 14 has a transverse hole 14*a*, and a window and index structure (not shown) through which the user can see the indication of the graduations on the worktable 200 indicative to the length of the workpiece under cutting.

The adjusting handle 18 is comprised of a grip 20 and a coupling frame 22. The grip 20 is orthopedically engineered for comfortable gripping with the hand, having a mounting hole 20*a*. The coupling frame 22 is an open frame having a first through hole 22*a*, a second through hole 22*b*, and a third through hole 22*c*. As shown in FIGS. 4 and 5, a pivot pin 24 is fastened to the transverse hole 14*a* of the guiding seat 14 and the first through hole 22*a* of the coupling frame 22 to pivotally couple the adjusting handle 18 to the guiding seat 14 of the main body 10, so that the adjusting handle 18 is turnable about the pivot pin 24 relative to the guiding seat 14 between two reversed directions. Further, a pin 26 is inserted through the second through hole 22*b* of the coupling frame 22 and connected firmly with the coupling frame 22.

The trigger 28 has a hooked stop portion 28*a*, a pressable portion 28*b*, a through hole 28*c*, and an arched guiding hole 28*d*. A pivot pin 30 is fastened to the third through hole 22*c* of the coupling frame 22 and the through hole 28*c* of the trigger 28 to pivotally secure the trigger 28 to the coupling frame 22 of the adjusting handle 18, for enabling the trigger 28 to be turned relative to the adjusting handle 18 between a first position where the hooked stop portion 28*a* is stopped against the worktable 200, and a second position where the hooked stop portion 28*a* is kept away from the worktable 200. The pressable portion 28*b* is maintained extended out of the coupling frame 22 for pressing by the finger of a user for moving the trigger 28 from the first position to the second position.

The spring member 32 is a coil spring mounted on the pivot pin 30, having one end stopped against one side of the coupling frame 22 and the other end stopped against the trigger 28. The spring member 32 imparts a push force to the trigger 28 to force the hooked stop portion 28*a* into contact with the front bottom side of the worktable 200. Further, a guiding pin 34 is inserted through the mounting hole 20*a* of the grip 20 and the arched guiding hole 28*d* of the trigger 28 to guide movement of the trigger 28 stably between the first position and the second position.

The clamp 36 is a plate member provided at the rear end 10*b* of the main body 10, having a through hole 36*a* and a stop portion 36*b*. Further, a coil spring 38 is stopped between the stop plate 16 and the clamp 36.

The link 40 is a rod member longitudinally inserted in proper order through the main body 10, the through hole 16*a* of the stop plate 16, the spring 38, and the through hole 36*a* of the clamp 36, having one end terminating in a hook 40*a*, which is hooked on the pin 26, and the other end terminating in a screw rod 40*b*, which is screwed up with a nut 42.

Figure 6:
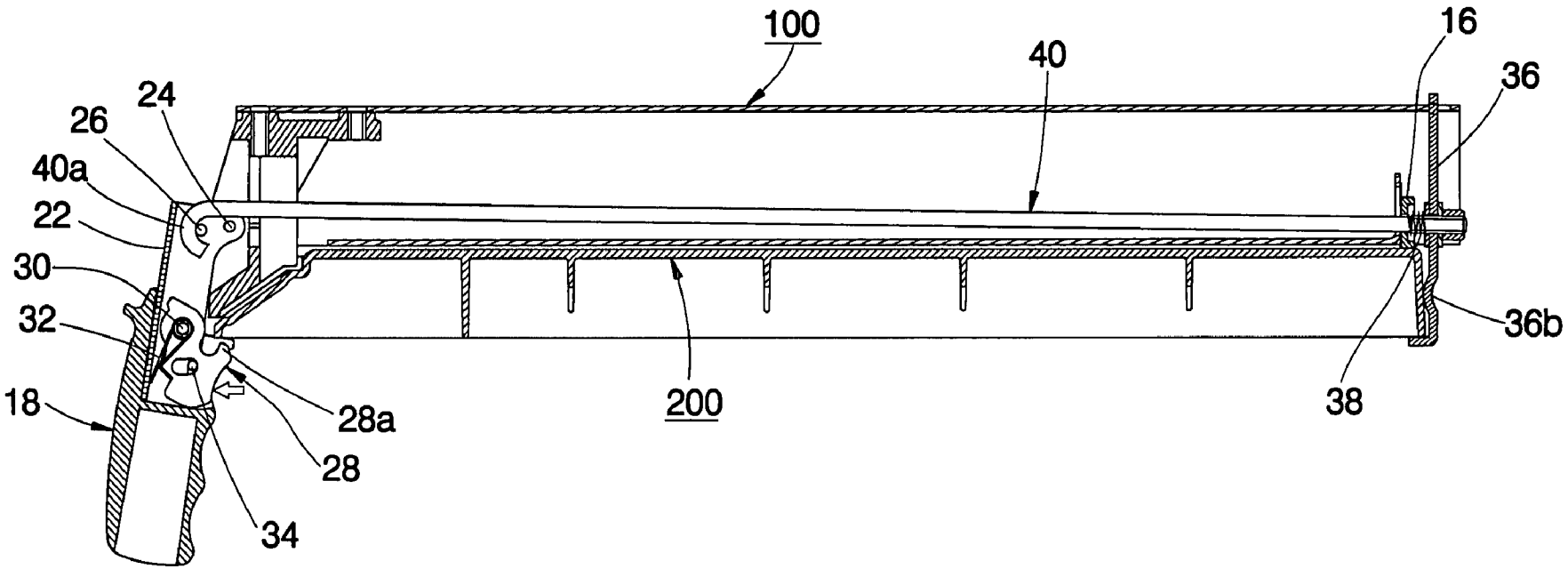
FIG. 6 is similar to FIG. 5 but showing the trigger pressed.

The positioning of the rip fence 100 on the worktable 200 and its adjustment are outlined hereinafter with reference to FIGS. 5–7.

FIG. 5 shows the rip fence 100 locked to the worktable 200 where the adjusting handle 18 is kept suspended downwards, the hooked stop portion 28*a* of the trigger 28 is forced by the spring member 32 into contact with the front bottom side of the worktable 200, and the clamp 36 is dragged by the link 40 to keep the stop portion 36*b* stopped at the rear side of the worktable 200.

Figure 7:
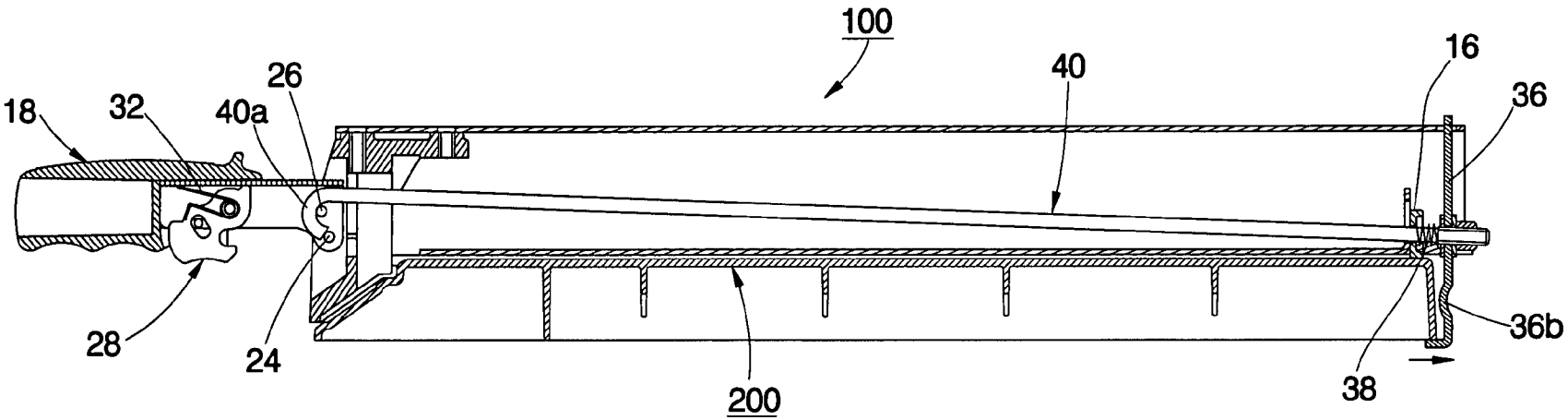
FIG. 7 is similar to FIG. 6 but showing the adjusting handle lifted, the rip fence unlocked.

When wishing to unlock the rip fence 100 from the worktable 200, press the pressable portion of the trigger 28 to move the hooked stop portion 28*a* away from the worktable 200 (see FIG. 6), and then turn the adjusting handle 18 upwards to change the position of the pin 26, as shown in FIG. 7. At this time, the spring 38 pushes the clamp 36 outwards from the worktable 200, and therefore the rip fence 100 is unlocked and can be moved on the worktable 200 to a desired position. After the rip fence 100 has been moved on the worktable 200 to the desired position, turn the adjusting handle 18 downwards to lock the rip fence 100 to the worktable 200 again, as shown in FIG. 5.

As indicated above, when the user touches the adjusting handle 18 accidentally without pressing the trigger 28 during cutting operation, the rip fence 100 is maintained locked to the worktable 200. Therefore, the trigger 28 ensures safety use of the rip fence 100.

Although a particular embodiment of the invention has been described in detail for purposes of illustration, various modifications and enhancements may be made without departing from the spirit and scope of the invention. Accordingly, the invention is not to be limited except as by the appended claims.

What is claimed is:

1. A rip fence for movable and positionable use on a worktable of a machine, said rip fence comprising:

a main body having a front end and a rear end;

an adjusting handle pivoted to the front end of said main body;

a trigger pivoted to said adjusting handle and turnable between a first position and a second position, said trigger having a stop portion and a pressable portion, the stop portion of said trigger being stopped against a front end of the worktable when said trigger is moved to said first position, the stop portion of said trigger being spaced from the front end of the worktable when said trigger is moved to said second position;

a clamp provided at the rear end of said main body, said clamp having a stop portion stoppable at a rear end of the worktable; and a link coupled between said adjusting handle and said clamp;

wherein when pressing the pressable portion of said trigger to move said trigger from said first position to said second position and then lifting said adjusting handle, said link will be forced to move said clamp away from the worktable, for enabling said rip fence to be moved on said worktable to a desired position.

2. The rip fence as claimed in claim 1, further comprising a spring member provided between said adjusting handle and said trigger for imparting a push force to said trigger to force the stop portion of said trigger into contact with said worktable.

3. The rip fence as claimed in claim 2, wherein said link has a first end terminating in a hook, which is hooked on a pin provided inside said adjusting handle, and a second end longitudinally inserted through said main body and fastened to said clamp.

4. The rip fence as claimed in claim 3, further comprising a stop plate fixedly provided at the rear end of said main body, said stop plate having a through hole for the passing of said link, and a spring member mounted on said link and stopped between said stop plate and said clamp for pushing said clamp away from the rear end of the worktable when the user lifts said adjusting handle.

5. The rip fence as claimed in claim 4, further comprising a guiding pin inserted through an arched guiding hole of said trigger and fastened to said adjusting handle to guide movement of said trigger between said first position and said second position.

* * * * *